US011514749B2

(12) United States Patent
Dalmia et al.

(10) Patent No.: US 11,514,749 B2
(45) **Date of Patent: *Nov. 29, 2022**

(54) USING MOBILE DEVICES TO OPERATE GAMING MACHINES

(71) Applicant: SG Gaming, Inc., Las Vegas, NV (US)

(72) Inventors: Mili Dalmia, Karnataka (IN); Walter Eisele, Reno, NV (US); Chandradeep Gandhi, Karnataka (IN); Joseph Randolph Hedrick, Reno, NV (US); Bala Kuthyar, Marietta, GA (US); Ramesh Gandhi Mathiyalagan, Tamil Nadu (IN); Yogendrasinh Hematji Rajput, Karnataka (IN); Sunil Somanna Subramani, Karnataka (IN)

(73) Assignee: SG Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/536,910

(22) Filed: Nov. 29, 2021

(65) Prior Publication Data

US 2022/0084358 A1 Mar. 17, 2022

Related U.S. Application Data

(63) Continuation of application No. 16/986,746, filed on Aug. 6, 2020, now Pat. No. 11,217,062.

(30) Foreign Application Priority Data

Jun. 15, 2020 (IN) ..... 202041025132

(51) Int. Cl.
*G07F 17/32* (2006.01)
*G07F 17/34* (2006.01)

(52) U.S. Cl.
CPC ..... *G07F 17/3223* (2013.01); *G07F 17/34* (2013.01)

(58) Field of Classification Search
CPC ..... G07F 17/3223; G07F 17/34
See application file for complete search history.

(56) References Cited

U.S. PATENT DOCUMENTS

| | | | |
|---|---|---|---|
| 6,835,134 | B2 | 12/2004 | Poole et al. |
| 6,846,238 | B2 | 1/2005 | Wells |
| 6,932,704 | B2 | 8/2005 | Walker et al. |
| 7,004,837 | B1 | 2/2006 | Crowder, Jr. et al. |
| 7,390,263 | B1 | 6/2008 | Acres |
| 7,413,513 | B2 | 8/2008 | Nguyen et al. |
| 7,437,147 | B1 | 10/2008 | Luciano, Jr. |
| 7,611,409 | B2 | 11/2009 | Muir et al. |

(Continued)

*Primary Examiner* — Werner G Garner

(57) ABSTRACT

A mobile device with remote play application is used to operate a gaming machine with a separately releasable module (SRM). The gaming machine and the mobile device are connected to a gaming network. In response to a visual code displayed on the gaming machine being captured by the mobile device, both a web socket connection and Virtual Network Computing (VNC) session are established between the SRM and the software application. The VNC session reproduces a video button panel of the gaming machine in the remote play application. The gaming machine is operated via touch inputs to the reproduced video button panel. To limit a remote session to mobile devices in close proximity to the gaming machine, the SRM sends an audio code to the mobile device and only maintains the session in response to receiving an echo of the audio code over the web socket connection.

23 Claims, 8 Drawing Sheets

(56) References Cited

U.S. PATENT DOCUMENTS 7,699,703 B2 4/2010 Muir et al.
7,758,417 B2 7/2010 Jorasch et al.
7,967,682 B2 6/2011 Huizinga
7,976,384 B2 7/2011 Griswold
8,152,634 B2 4/2012 Gagner et al.
8,251,809 B2 8/2012 Griswold
8,272,947 B2 9/2012 Gagner et al.
8,282,465 B2 10/2012 Giobbi
8,333,655 B2 12/2012 Gagner et al.
8,393,955 B2 3/2013 Arezina et al.
8,430,745 B2 4/2013 Agarwal et al.
8,469,800 B2 6/2013 LeMay et al.
8,550,903 B2 10/2013 Lyons et al.
8,597,111 B2 12/2013 LeMay et al.
8,608,569 B2 12/2013 Carrico et al.
8,613,659 B2 12/2013 Nelson et al.
8,613,668 B2 12/2013 Nelson et al.
8,622,836 B2 1/2014 Nelson et al.
8,632,403 B2 1/2014 Nguyen et al.
8,636,590 B2 1/2014 Griswold
8,721,434 B2 5/2014 Nelson et al.
8,734,236 B2 5/2014 Arezina et al.
8,821,274 B2 9/2014 Lyons et al.
8,827,813 B2 9/2014 Lemay et al.
8,827,814 B2 9/2014 Lemay et al.
8,834,254 B2 9/2014 Buchholz et al.
8,845,422 B2 9/2014 Weber
8,870,647 B2 10/2014 Huizinga
8,876,595 B2 11/2014 Nelson et al.
8,876,596 B2 11/2014 Patceg et al.
8,926,422 B2 1/2015 Anderson et al.
8,932,140 B2 1/2015 Gagner et al.
8,944,916 B2 2/2015 Abouchar et al.
8,956,224 B2 2/2015 Gagner et al.
8,961,306 B2 2/2015 LeMay et al.
9,039,523 B2 5/2015 Price et al.
9,098,975 B2 8/2015 Walker et al.
9,123,204 B2 9/2015 Rader et al.
9,142,098 B2 9/2015 Gagner et al.
9,147,313 B2 9/2015 Nelson et al.
9,153,095 B2 10/2015 Adiraju et al.
9,196,121 B2 11/2015 Walker et al.
9,218,715 B2 12/2015 Price et al.
9,224,263 B2 12/2015 Gagner et al.
9,224,268 B2 12/2015 Aoki et al.
9,235,953 B2 1/2016 Earley et al.
9,235,964 B2 1/2016 Ward et al.
9,240,100 B2 1/2016 Page et al.
9,269,231 B2 2/2016 Curtin et al.
9,311,769 B2 4/2016 LeMay et al.
9,336,647 B2 5/2016 Nelson et al.
9,355,519 B2 5/2016 Lyons et al.
9,361,755 B2 6/2016 Gagner et al.
9,367,835 B2 6/2016 Nelson et al.
9,375,644 B2 6/2016 Nelson et al.
9,412,227 B2 8/2016 Nelson et al.
9,412,228 B2 8/2016 Arezina et al.
9,424,713 B2 8/2016 Walker et al.
9,443,384 B2 9/2016 Price et al.
9,472,049 B2 10/2016 Allen et al.
9,483,906 B2 11/2016 LeMay et al.
9,489,794 B2 11/2016 Hilbert et al.
9,520,023 B2 12/2016 Lyons et al.
9,520,030 B2 12/2016 Gagner et al.
9,524,609 B2 12/2016 Shorrock et al.
9,530,277 B2 12/2016 Nelson et al.
9,547,954 B2 1/2017 Anderson et al.
9,552,697 B2 1/2017 Earley et al.
9,564,010 B2 2/2017 Page et al.
9,595,165 B2 3/2017 Gagner et al.
9,619,968 B2 4/2017 Gagner et al.
9,626,832 B2 4/2017 Patceg et al.
9,640,022 B2 5/2017 Carrico et al.
9,640,033 B2 5/2017 Gagner et al.
9,646,452 B2 5/2017 Parra et al.
9,659,437 B2 5/2017 Kelly et al.
9,666,027 B2 5/2017 Curtin et al.
9,697,683 B2 7/2017 Lyons et al.
9,734,661 B2 8/2017 Lyons et al.
9,734,667 B2 8/2017 Walker et al.
9,754,443 B2 9/2017 Hedrick et al.
9,786,123 B2 10/2017 Huizinga
9,805,547 B2 10/2017 Price et al.
9,805,554 B2 10/2017 Michel et al.
9,824,532 B2 11/2017 Abouchar et al.
9,824,536 B2 11/2017 Shorrock et al.
9,842,468 B2 12/2017 Gagner et al.
9,852,578 B2 12/2017 Nelson et al.
9,875,607 B2 1/2018 Nelson et al.
9,875,621 B1 1/2018 Michel et al.
9,928,502 B2 3/2018 Curtin et al.
9,928,681 B2 3/2018 LeMay, Jr. et al.
9,997,015 B2 6/2018 Sylla et al.
10,013,850 B2 7/2018 Nelson et al.
10,068,417 B2 9/2018 Toohey et al.
10,068,429 B2 9/2018 Gagner et al.
10,074,235 B2 9/2018 Walker et al.
10,102,714 B2 10/2018 Page et al.
10,115,270 B2 10/2018 Gagner et al.
10,121,312 B2 11/2018 Mien et al.
10,121,318 B2 11/2018 LeMay et al.
10,140,811 B2 11/2018 Lyons et al.
10,140,814 B2 11/2018 Anderson et al.
10,192,400 B2 1/2019 Price et al.
10,192,401 B2 1/2019 Nelson
10,217,317 B2 2/2019 Nelson et al.
10,217,319 B2 2/2019 Gagner et al.
10,242,523 B2 3/2019 Lyons et al.
10,297,105 B2 5/2019 LeMay et al.
10,332,344 B2 6/2019 Petersen et al.
10,339,757 B2 7/2019 Toohey et al.
10,360,763 B2 7/2019 Higgins et al.
10,373,430 B2 8/2019 Higgins et al.
10,391,392 B2 8/2019 Nelson et al.
10,395,465 B2 8/2019 Bytnar et al.
10,410,471 B2 9/2019 Gagner et al.
10,417,867 B2 9/2019 Nelson
10,424,151 B1 9/2019 Higgins et al.
10,453,297 B2 10/2019 LeMay et al.
10,460,560 B2 10/2019 Cunningham, II et al.
10,460,563 B2 10/2019 Miri et al.
10,510,207 B2 12/2019 Lyons et al.
10,529,191 B2 1/2020 Anderson et al.
10,573,129 B2 2/2020 Higgins et al.
10,607,437 B2 3/2020 Little et al.
10,607,442 B2 3/2020 Toohey et al.
10,621,824 B2 4/2020 Petersen et al.
10,621,826 B2 4/2020 Higgins et al.
10,643,423 B2 5/2020 Lyons et al.
10,643,424 B2 5/2020 Fee et al.
2009/0197671 A1 8/2009 Kelly et al.
2013/0130777 A1 5/2013 Lemay et al.
2014/0256407 A1 9/2014 Graf et al.
2014/0315619 A1 10/2014 Bowers et al.
2018/0130259 A1 5/2018 Leefsma et al.
2018/0130290 A1 5/2018 Lyons
2019/0102967 A1 4/2019 Lyons et al.
2020/0082663 A1 3/2020 Lyons et al.

USING MOBILE DEVICES TO OPERATE GAMING MACHINES

CROSS REFERENCE TO RELATED APPLICATIONS

This application is a Continuation of U.S. patent application Ser. No. 16/986,746, which was filed on Aug. 6, 2020, and which claims the benefit of Indian Patent Application No. 202041025132, filed Jun. 15, 2020, both of which are incorporated herein by reference in their respective entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2021, SG Gaming, Inc.

FIELD OF THE INVENTION

The present invention relates generally to gaming machines and, more particularly, relates to using mobile devices to operate gaming machines.

BACKGROUND OF THE INVENTION

To operate a wagering game played via a gaming machine, a player typically must physically touch the machine. For example, the player must press physical or virtual buttons on a button deck to select a wager, initiate play, view game instructions and pays, cash out any credits on a credit meter, request service, and modify game settings (e.g., sound volume). And the player may need to touch various options on a primary display outfitted with a touch screen in order to progress through game play. As a result of such physical contact with the gaming machine, the gaming machine may pick up, carry, and spread germs such as bacteria, viruses, and mold spores. As the gaming machine is played by other players, the germs on the machine may infect other individuals by cross-contamination with potentially harmful effects.

One solution to this cross-contamination problem is to periodically sanitize the gaming machine, such as between gaming sessions with different players. This solution, however, requires casino attendants to timely supervise or otherwise be made aware of the conclusion of a gaming session and may be time-consuming and labor intensive.

Another solution is to minimize players' physical contact with the gaming machine by enabling players to use their mobile devices (e.g., smartphones or tablets) to operate the gaming machine. Heretofore, the proposed technologies for implementing this solution suffer from such shortcomings as being complicated, expensive to manufacture, subject to significant regulatory hurdles, and/or difficult to integrate with existing gaming machines.

SUMMARY OF THE INVENTION

According to an embodiment of the present invention, a mobile device with remote play application is used to operate a gaming machine with a separately releasable module (SRM). The SRM may be installed in an existing gaming machine with an existing CPU and operating system. The gaming machine and the mobile device are connected to a gaming network. In response to a visual code displayed on the gaming machine being captured by the mobile device, both a web socket connection and Virtual Network Computing (VNC) session are established between the SRM and the software application. The VNC session reproduces a video button panel of the gaming machine in the remote play application. The gaming machine is operated and played via touch inputs to the reproduced video button panel. To limit a remote session to mobile devices in close proximity to the gaming machine, the SRM sends an audio code to the mobile device and only maintains the session in response to receiving an echo of the audio code over the web socket connection.

Additional aspects of the invention will be apparent to those of ordinary skill in the art in view of the detailed description of various embodiments, which is made with reference to the drawings, a brief description of which is provided below.

Figure 1:
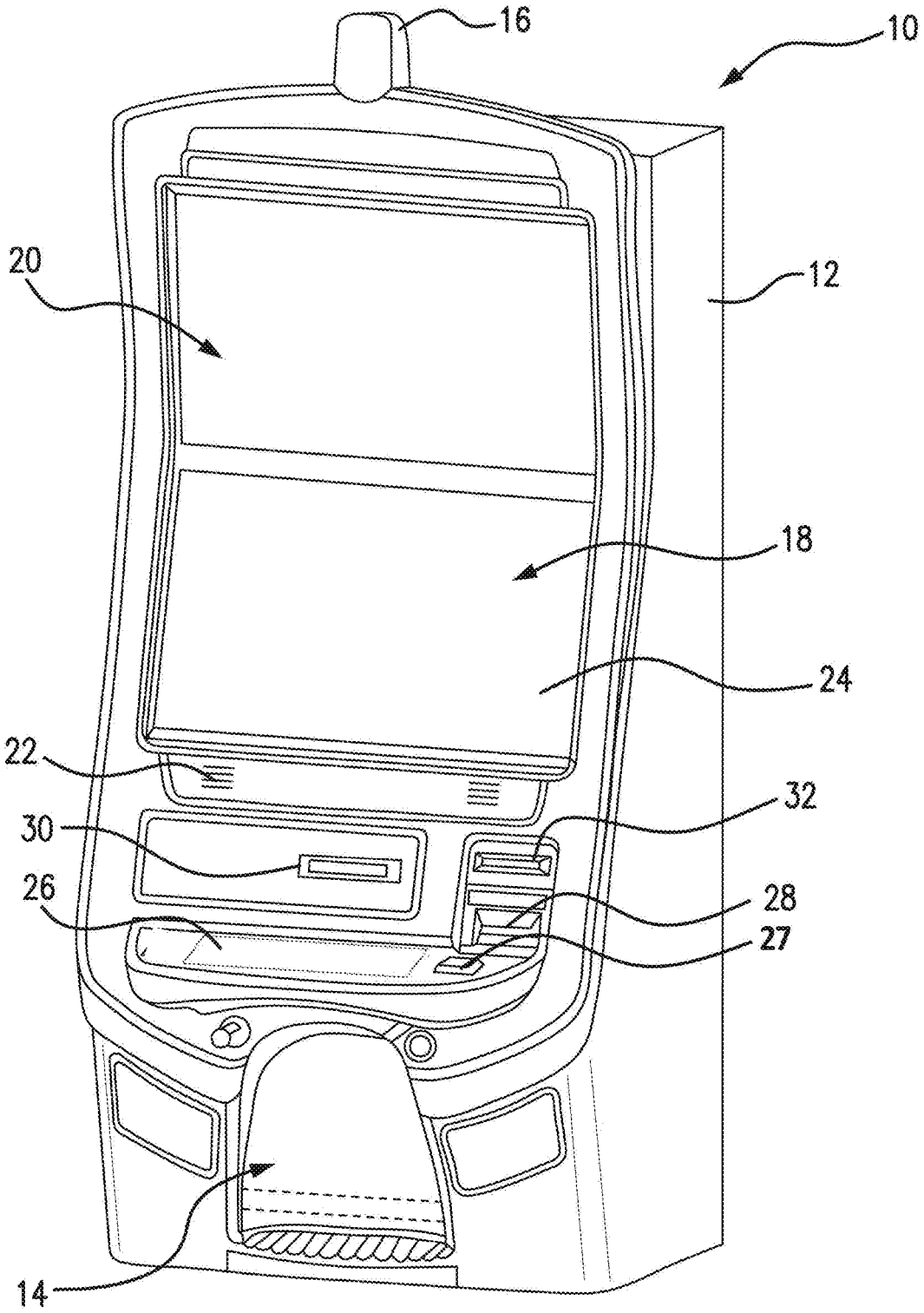
FIG. 1 is an isometric view of a free-standing gaming machine used in an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. The gaming machine 10 may be any type of gaming terminal or machine and may have varying structures and methods of operation. For example, in some aspects, the gaming machine 10 is an electronic gaming terminal configured to play a video casino game, such as slots, keno, poker, blackjack, roulette, craps, etc. The gaming machine 10 may take any suitable form, such as a floor-standing, stationary model as shown, bartop model, workstation-type console model, etc. The gaming machine 10 may be primarily dedicated for use in playing wagering games.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display/screen 18, a secondary display/screen 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, a video button panel 26, one or more electromechanical push-buttons 27, a bill/ticket acceptor 28, a card reader/writer 30, a ticket dispenser 32, and player-accessible ports (e.g., audio output jack for headphones, video headset jack, USB port, wireless transmitter/receiver, etc.). The video button panel 26 may be an iDeck™ panel offered on slot machines manufactured by the assignee, SG Gaming, Inc., of the present invention. The video button panel 26 is an elongated video display outfitted with a touch screen and mounted to a ledge extending forwardly towards a player positioned in front of the gaming machine 10. The ledge is disposed below the primary display 18. It should be understood that numerous other peripheral devices and other elements exist and are readily utilizable in any number of combinations to create various forms of a gaming machine in accord with the present concepts.

The player input devices, such as the touch screen 24 (in front of primary display 18), video button panel 26, push-button(s) 27, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" push-button or soft touch key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
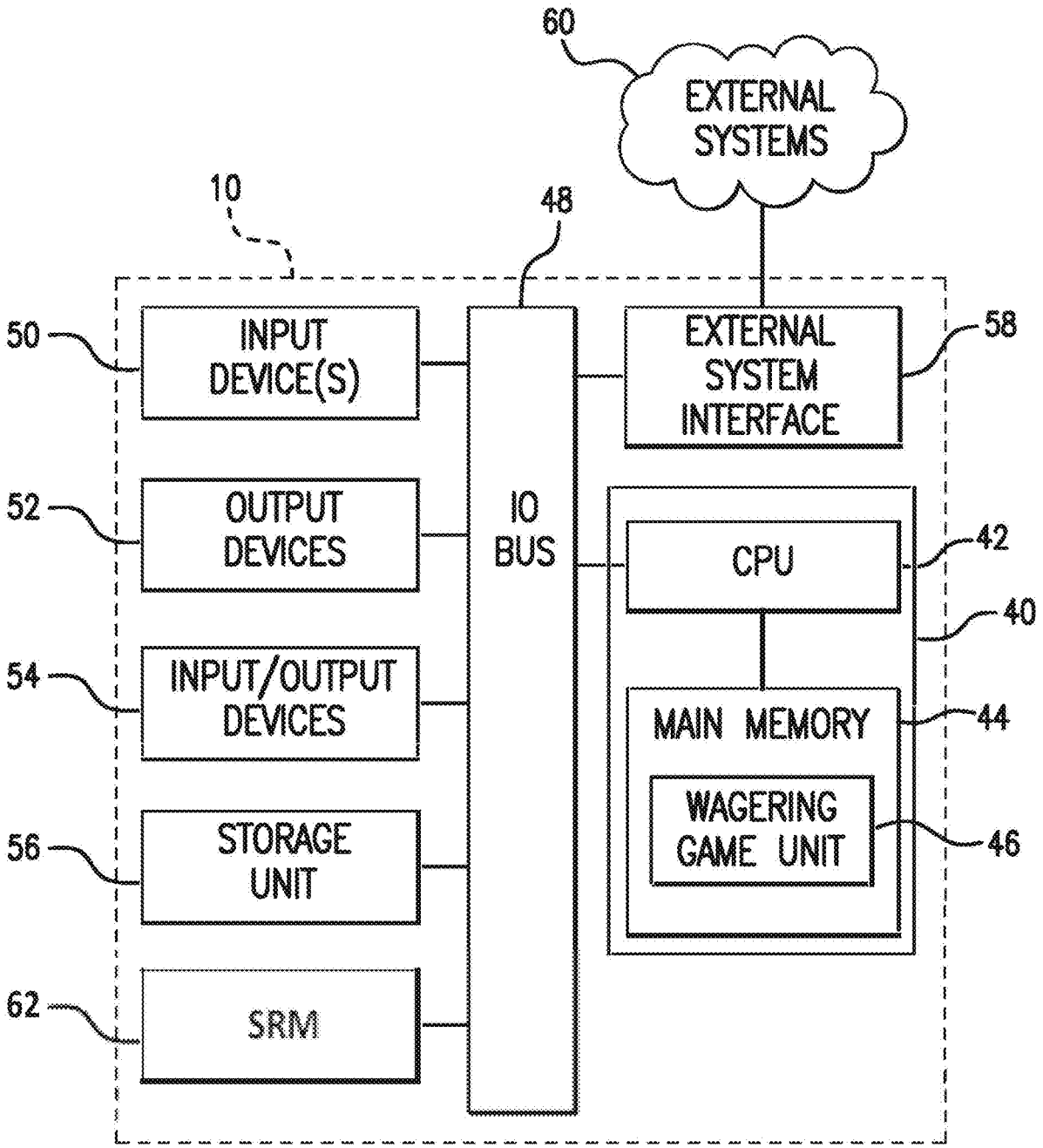
FIG. 2 is a schematic view of a gaming system including the gaming machine and used in an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The game-logic circuitry 40 may, for example, execute an operating system that leverages and is layered on top of a Microsoft Windows operating system (OS) such as Windows 7 or Windows 10. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's electronic mobile device (e.g., smart phone, tablet, electronic wallet, etc.) and the external-system interface 58 is configured to facilitate wireless communication and data transfer between the mobile device and the gaming machine 10, such as via a common Wi-Fi access point on the network, a near-field communication (NFC) path, or a Bluetooth connection. If the external system 60 includes a gaming network, the gaming machine may be identified on the network using an Internet Protocol (IP) address and may be wired, or wirelessly connect, to a Wi-Fi access point on the network via the external system interface 58. A player's mobile device may likewise be wirelessly connected to the same Wi-Fi access point, thereby enabling the mobile device to communicate with the gaming machine 10 over the network. As discussed below, a separately releasable module (SRM) 62 is installed on the gaming machine 10 without modifying or reconfiguring the existing operating system in the machine. To enable a player to interact with and play the machine 10 through their mobile device without touching the machine 10, the SRM 62 communicates with a software application on the player's mobile device on the one hand and the touch screen displays (e.g., the video button panel 26 and the primary display 18 in FIG. 1) of the gaming machine 10 on the other hand.

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)— all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), non-volatile random access memory (NVRAM), magnetic-disk storage media, optical storage media, flash memory, etc.

Figure 3:
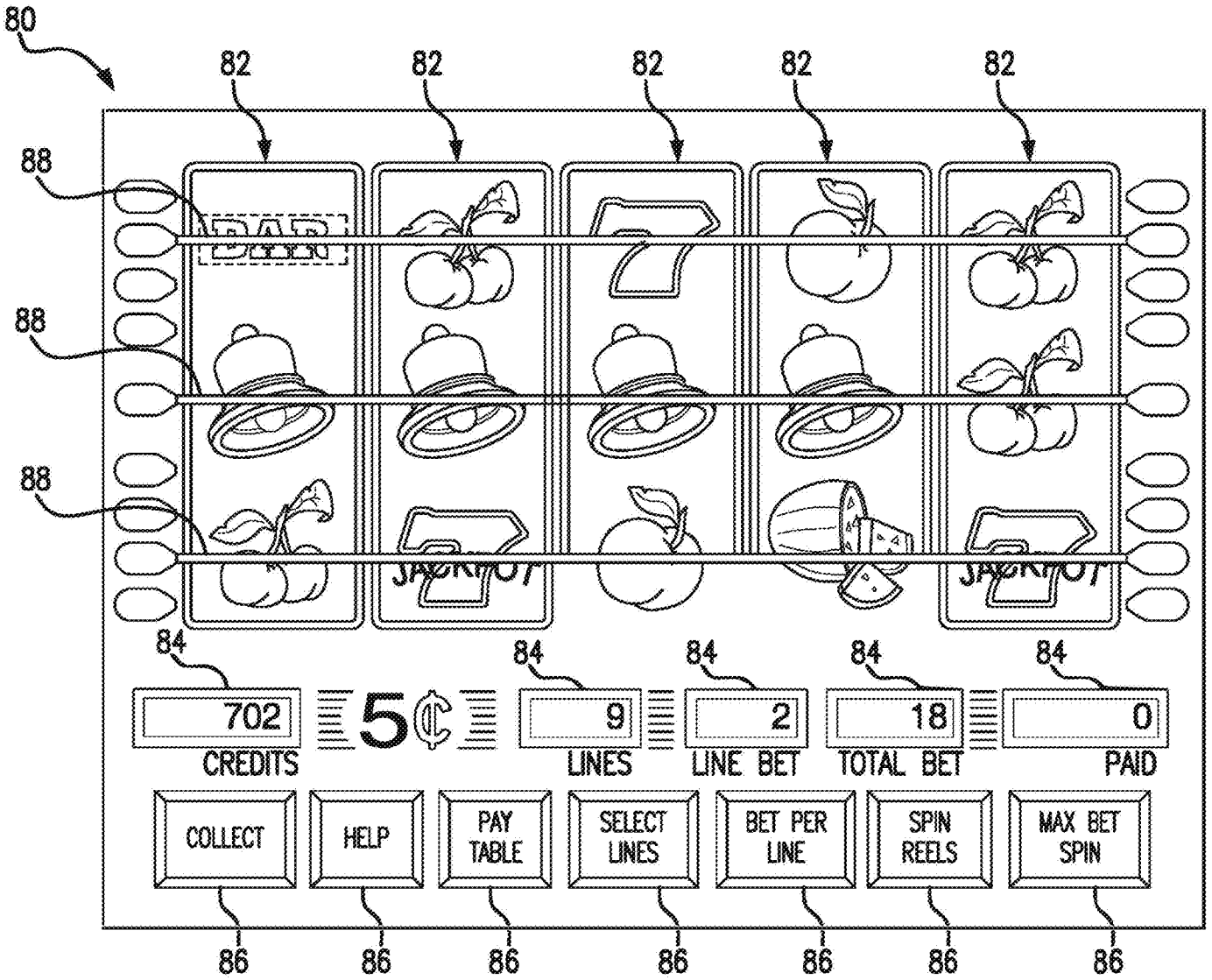
FIG. 3 is an image of an exemplary basic-game screen of a wagering game displayed on the gaming machine.

Referring now to FIG. 3, there is illustrated an image of a basic-game screen 80 adapted to be displayed on the primary display 18 or the secondary display 20 (see FIG. 1). The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the video button panel 26 and push-buttons 27 (see FIG. 1). The game-logic circuitry operates to execute a wagering-game program causing the primary display 18 or the secondary display 20 (see FIG. 1) to display the wagering game.

In response to receiving an input indicative of a wager drawn on or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus games in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus games based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry transforms a physical player input, such as a player's pressing of a "Spin Reels" touch key or button, into an electronic data signal indicative of an instruction relating to the wagering game (e.g., an electronic data signal bearing data on a wager amount).

In the aforementioned method, for each data signal, the game-logic circuitry is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 (see FIG. 2) causes the recording of a digital representation of the wager in one or more storage media (e.g., storage unit 56 in FIG. 2), the CPU, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU (e.g., the wager in the present example). As another example, the CPU further, in accord with the execution of the stored instructions relating to the wagering game, causes the primary display, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server) in FIG. 2, means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
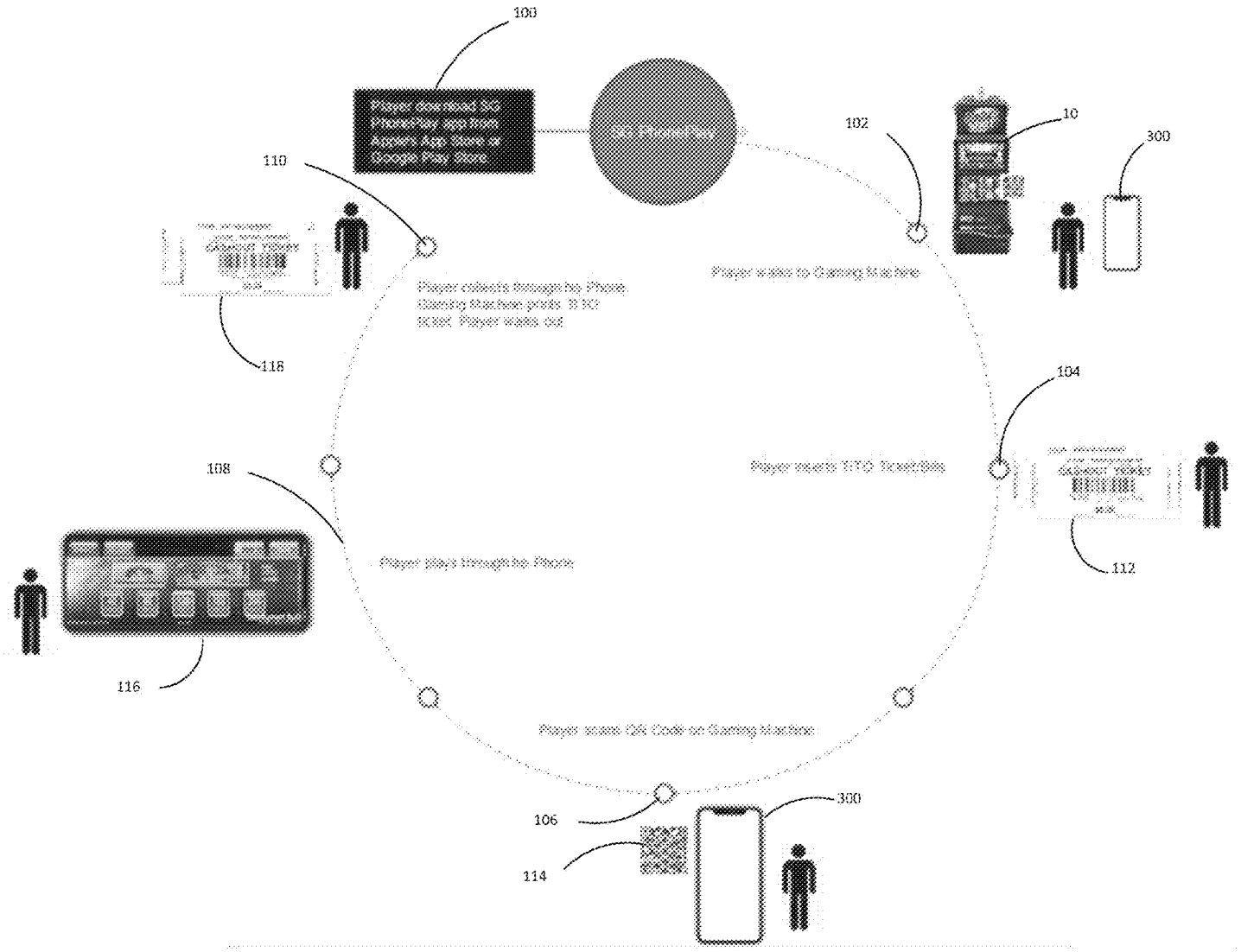
FIG. 4 is an overview cycle diagram generally illustrating how a player engages in a remote play session in which the player interacts with and plays a gaming machine through their mobile device in accordance with an embodiment of the present invention.

In accordance with an embodiment of the present invention, FIG. 4 is an overview process diagram generally illustrating how a player interacts with and plays a gaming machine 10 through their mobile device 300, thus minimizing physical contact with the gaming machine 10. At step 100, the player downloads and installs a software application (also referred to herein as the SG PhonePlay application or SG PhonePlay app) on their mobile device 300 from an online application store (e.g., the Apple App Store for an Apple device running the iOS operating system, or the Google Play Store for a device running the Android operating system) and connects their mobile device 300 to the casino's gaming network via Wi-Fi. At step 102, the player walks to an SG PhonePlay-compatible gaming machine 10, i.e., a machine containing the SRM 62 (see FIG. 2). At step 104, the player inserts money into a bill/ticket acceptor 28 (see FIG. 1) of the machine 10. The money, for example, may be in the form of a value-bearing ticket 112 or currency bills. At step 106, the player uses their mobile device 300 to scan a visual Quick Response (QR) code 114 displayed on the gaming machine 10. The QR code 114 may, for example, be displayed on a top corner of the primary display of the gaming machine 10. At step 108, while the player is in close proximity to the gaming machine 10, the player plays a wagering game presented on the gaming machine 10 through their mobile device 300. As discussed below, images on the video button panel 26 (see FIG. 1) of the gaming machine 10 may be reproduced on a video button panel 116 on the player's mobile device 300 and receive player inputs to operate the wagering game. At step 110, when the player concludes their gaming session, the player may press a "collect" or "cashout" button on the video button panel 116 displayed on their mobile device 300 to cause the gaming machine 10 to print and dispense a value-bearing ticket 118 from the ticket dispenser 32 (see FIG. 1) of the machine 10.

Figure 5:
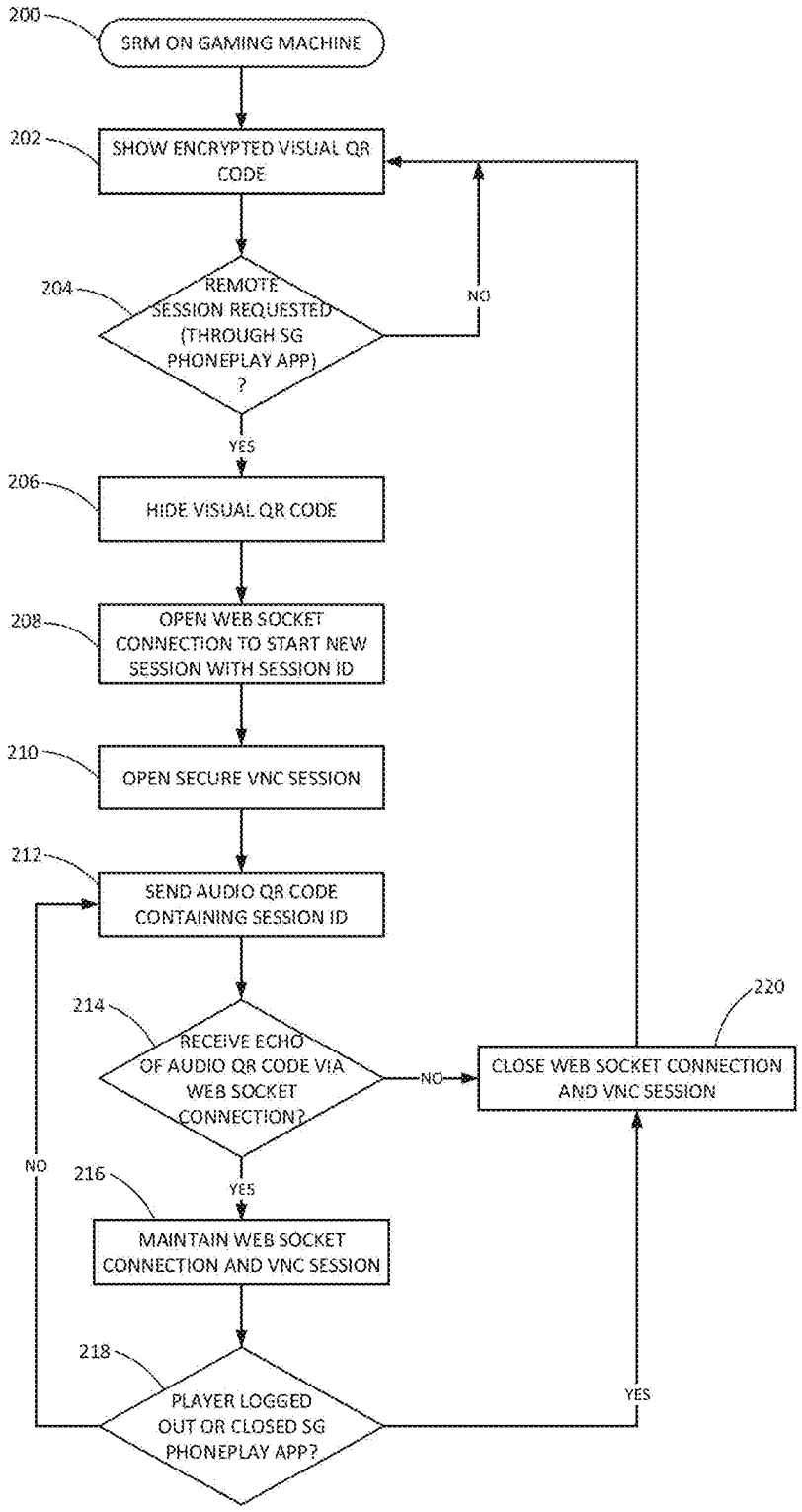
FIG. 5 is a detailed flow diagram illustrating operation of a separately releasable module (SRM) installed in a gaming machine to manage a remote play session in accordance with an embodiment of the present invention.

FIG. 5 is a detailed flow diagram illustrating operation of the SRM 62 (see FIG. 2) of a gaming machine in accordance with an embodiment of the present invention. At step 200, the SRM is installed in a gaming machine without modifying or reconfiguring the existing operating system in the machine. The gaming machine is connected to a Wi-Fi access point of a casino gaming network. Once installed, the SRM requires minimal or no additional configuration. At step 202, the SRM depicts an encrypted visual QR code on a top corner of the primary display of the gaming machine. The visual QR code may contain a unique identifier, such as a network IP address, of the gaming machine. At step 204, the SRM determines whether or not the SG PhonePlay application on a player's mobile device has requested a remote session by scanning the visual QR code with a camera of the mobile device. To enable peer-to-peer (i.e., one-to-one) communications between the SRM and the SG PhonePlay application, the player's mobile device may be wirelessly connected to the same Wi-Fi access point of the network as the gaming machine. In one embodiment, the visual QR code may embed an identifier for the Wi-Fi access point, and the SG PhonePlay application may automatically connect the mobile device to that access point in response to scanning the visual QR code. If a remote session has not been requested at step 204, the SRM returns to step 202. If, however, a remote session has been requested at step 204, the SRM hides the visual QR code at step 206. At step 208, the SRM opens or establishes a secure web socket connection with session identifier (ID) with the SG PhonePlay application to enable peer-to-peer communications therebetween. At step 210, the SRM opens or establishes a secure Video Network Computing (VNC) session with the SG PhonePlay application with respect to the video button panel 26 (see FIG. 1) of the gaming machine. In this VNC session, the SRM establishes the video button panel 26 as the VNC server, and the SG PhonePlay application on the player's mobile device acts as the VNC client for the video button panel 26. For the VNC session, the SRM and the SG PhonePlay application communicate over the web socket connection with a VNC standard protocol that is publicly available at www.tools.ietf.org/html/rfc6143, which is incorporated herein by reference in its entirety. The VNC session has a relatively low latency compared to some other methods for sharing graphics/video between two devices. The web socket connection and the VNC session are secured by industry standard encryption mechanisms and recurring authentication of the peer-to-peer connection. With the web socket connection and the VNC session established, the player can now operate and interact with the gaming machine and play the wagering game through the player's mobile device.

The SRM repeatedly performs a number of steps 212-218 to validate that the player's mobile device is in close proximity (e.g., within two meters) to the gaming machine. Such proximity enforcement may, for example, be performed once every five or ten seconds. At step 212, the SRM sends an ultrasonic audio QR code containing the session identifier. At step 214, the SRM determines whether or not it has received an echo of the audio QR code from the player's mobile device over the web socket connection. If the SRM has not received the echo after a predetermined number of attempts, the SRM closes the web socket connection and VNC session at step 220 and returns to step 202. If, however, the SRM has received the echo, the SRM maintains the web socket connection and VNC session at step 216. At step 218, the SRM determines whether or not the player has logged out or closed the SG PhonePlay application on the player's mobile device. If the player has logged out or closed the SG PhonePlay application, the SRM closes the web socket connection and VNC session at step 220 and returns to step 202. If, however, the player has not logged out or closed the SG PhonePlay application, the SRM returns to step 212 to again validate that the player's mobile device is in close proximity to the gaming machine.

Figure 6:
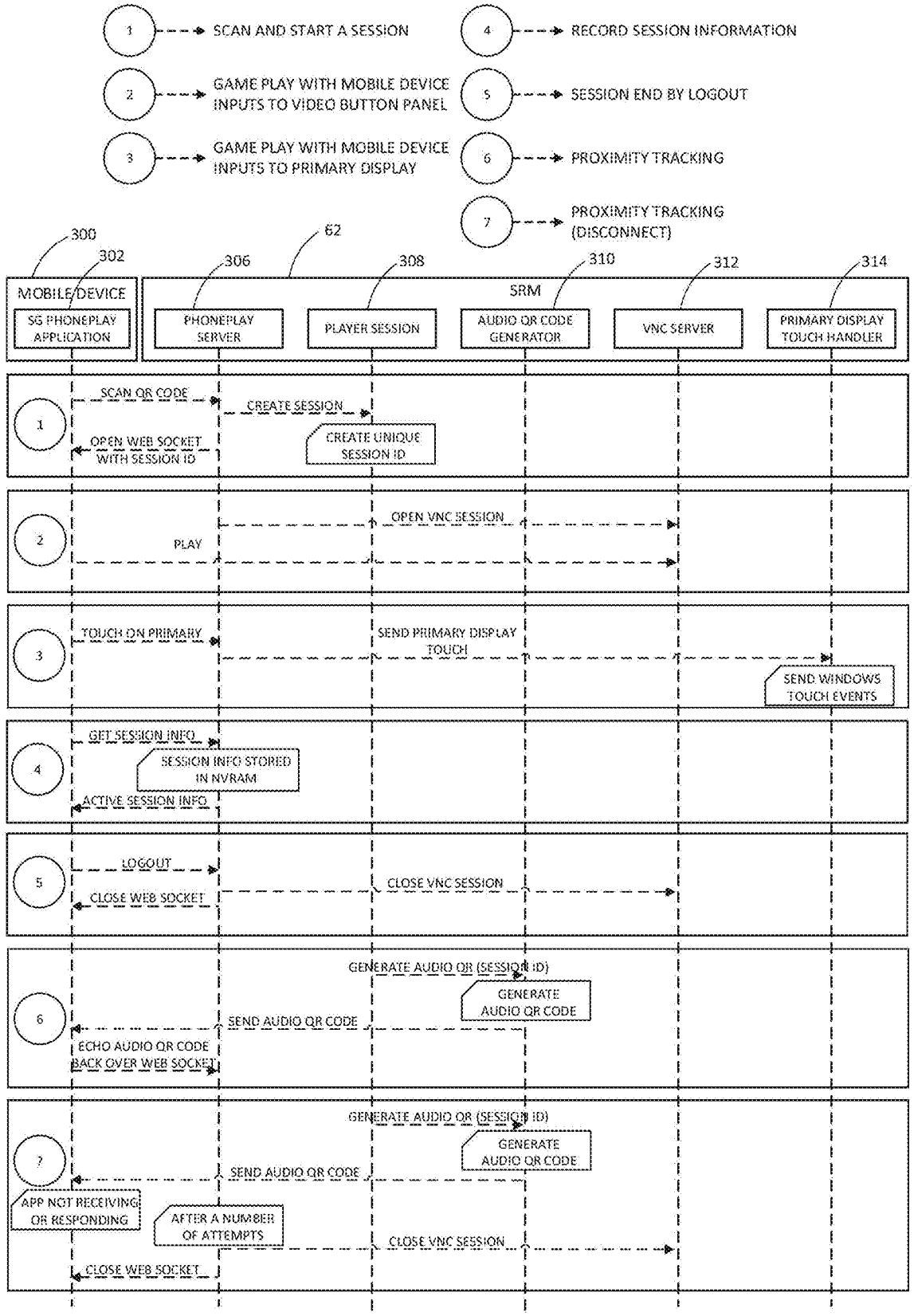
FIG. 6 illustrates sequence flows for aspects of a remote play session in accordance with an embodiment of the present invention.

FIG. 6 depicts sequence flows between the SG PhonePlay application 302 on a player's mobile device 300 and the SRM 62 installed in a gaming machine. The SRM 62 includes five logical modules, including a PhonePlay server 306, a player session module 308, an audio QR code generator 310, a VNC server 312 for the video button panel 26 (see FIG. 1), and a primary display touch handler 314.

Figure 8:
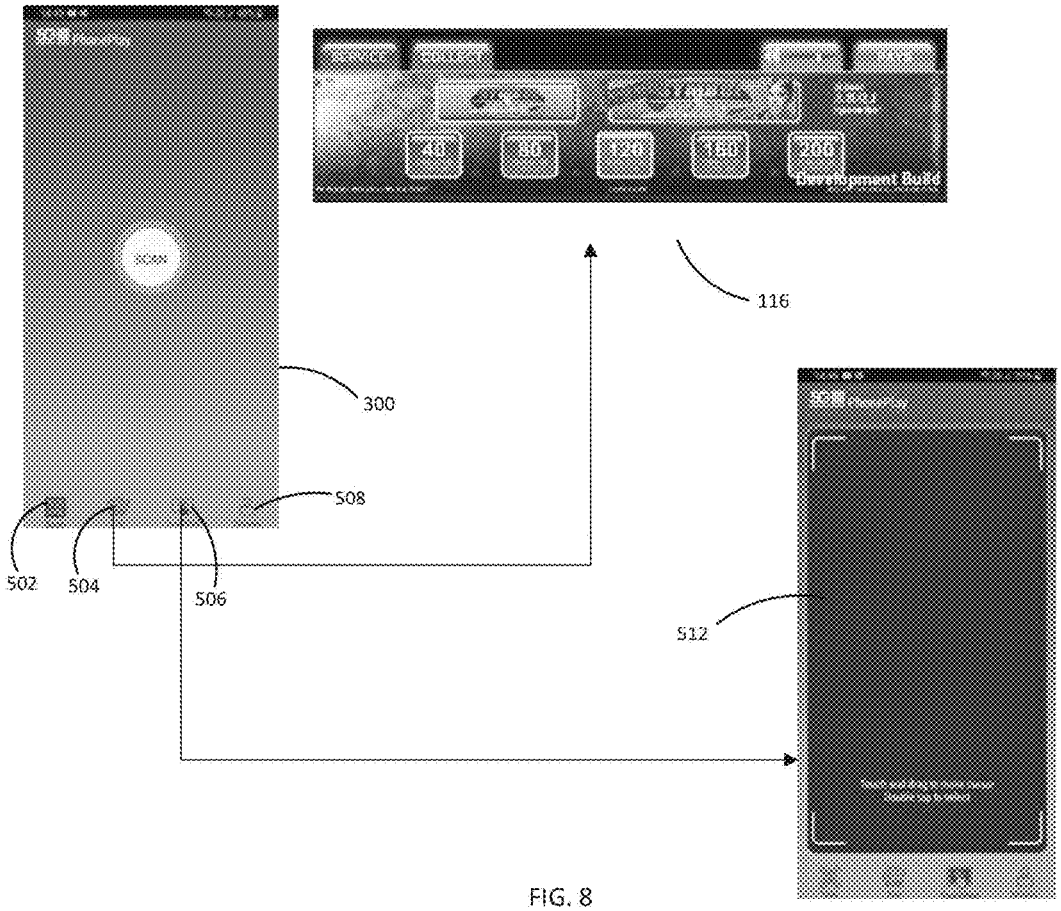
FIG. 8 is a representation of remote play session modes available in an application on a player's mobile device in accordance with an embodiment of the present invention.

Sequence flow no. 1 is to scan and start a remote session at the gaming machine. At the commencement of a remote session, the SG PhonePlay application 302 prompts the player for authorization of secure connections, for accessing a camera of the mobile device 300, and for monitoring a microphone of the mobile device 300 while using the application 302. Using a camera of the player's mobile device 300, the SG PhonePlay application 302 scans and decrypts an encrypted visual QR code that the PhonePlay Server 306 directs the primary display of the gaming machine to display. The visual QR code is encrypted to ensure that only the SG PhonePlay application 302 (and not other applications) can decrypt the visual QR code. The PhonePlay server 306 of the SRM 62, in turn, instructs the player session module 308 to create a player session with a unique session identifier. The PhonePlay server 306 then opens a secure web socket connection with the session identifier with the SG PhonePlay application 302 so that the SRM 62 and the mobile device 300 can communicate over that web socket connection (on the gaming network to which both the gaming machine and mobile device 300 are connected to the same Wi-Fi access point) in the sequence flows described below. Referring briefly to FIG. 8, when the SG PhonePlay application is open on the player's mobile device 300, the SG PhonePlay application has four selectable modes represented by labeled icons 502, 504, 506, and 508 at the bottom of the screen of the mobile device, including scan, play, touch pad, and session. To select a desired mode, the player touches the associated icon. To enter the scan mode for sequence flow no. 1 in FIG. 6, the player touches the scan icon 502 in FIG. 8.

Returning to FIG. 6, sequence flow no. 2 is to play a wagering game presented on the gaming machine by accepting player inputs to the player's mobile device 300 and emulating those inputs as touches to the video button panel 26 (see FIG. 1) of the gaming machine. For this sequence flow, the player selects the play icon 504 in FIG. 8 which, in turn, causes the SG PhonePlay application to reproduce the video button panel 26 (see FIG. 1) as the video button panel 116 on the screen of the player's mobile device 300. In one embodiment, once the SG PhonePlay application 302 successfully scans the visual QR code pursuant to sequence flow no. 1, the application may automatically enter the play mode without player selection of the play icon 504. The PhonePlay server 306 instructs the VNC server 312 to open a VNC session with the SG PhonePlay application 302 as the VNC client with respect to the video button panel of the gaming machine. The player may then play the wagering game by making touch inputs to the rendered video button panel 116 in FIG. 8. In response to a touch input, an action is executed on the gaming machine. The action may, for example, be selecting a wager (e.g., 40 credits, 80 credits, 120 credits, 160 credits, or 200 credits), initiating play (e.g., "spin" or "play" button), viewing game instructions and pays (e.g., "pays" button), cashing out any credits on a credit meter (e.g., "collect" button), requesting service (e.g., "service" button), or modifying game settings (e.g., speaker volume button). To place a wager, the player must first insert money into the bill/ticket acceptor 28 (see FIG. 1) of the gaming machine to establish a credit balance on the credit meter. In response to the action of cashing out any credits on the credit meter, the gaming machine prints and dispenses a ticket from the ticket dispenser 32 (see FIG. 1). Because of the VNC session, the inputs to the rendered video button panel 116 are as if they are being made directly to the video button panel 26 (see FIG. 1) of the gaming machine.

Sequence flow no. 3 is to play the wagering game by accepting player inputs to the player's mobile device and emulating those inputs as touches to the primary display 18 (see FIG. 1) of the gaming machine. For this sequence flow, the player selects the touch pad icon 506 in FIG. 8 which, in turn, causes the SG PhonePlay application to render a blank touch pad 512 on the screen of the player's mobile device 300. A touch on the touch pad in the SG PhonePlay application 302 causes the PhonePlay server 306 to send the touch to the primary display touch handler 314 as Microsoft Windows touch events. In one embodiment, if the gaming machine does not include a video button panel 26 (see FIG. 1) as described in connection with sequence flow no. 2, all remote inputs to the gaming machine may be made in the touch pad mode. In another embodiment, if the mobile device has the larger form factor of a tablet or the like, the SRM 62 and the SG PhonePlay application 302 may establish a VNC session with respect to the primary display 18 (see FIG. 1) of the gaming machine. In this case, images on the primary display are reproduced on the player's mobile device 300 so that the player may play the wagering game by making touch inputs to the rendered primary display images.

Figure 7:
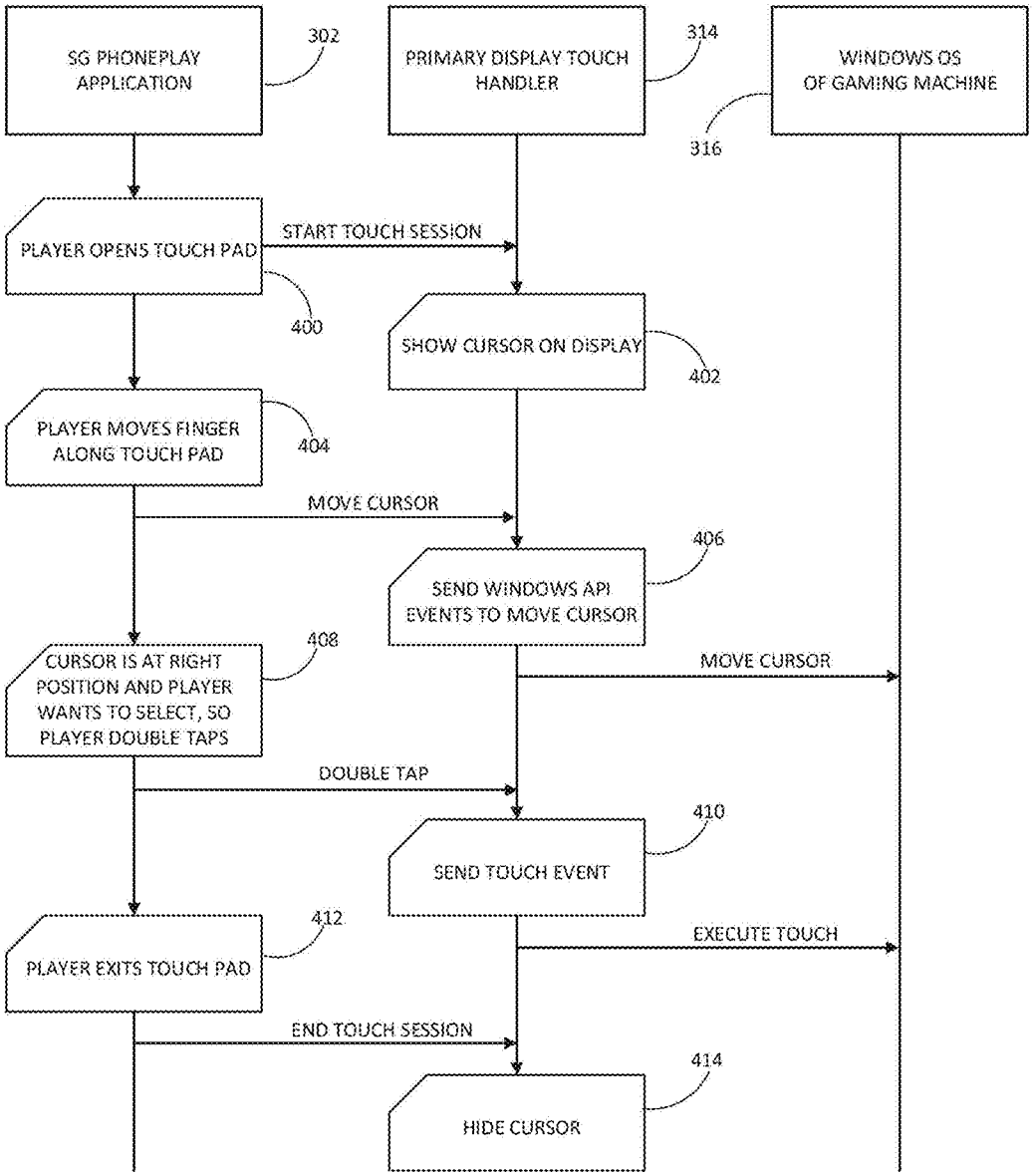
FIG. 7 is a detailed flow diagram of a touch pad mode of a remote play session in accordance with an embodiment of the present invention.

FIG. 7 shows further details of sequence flow no 3. At step 400, the player selects the touch pad icon 506 in FIG. 8 to open the touch pad on the screen of the mobile device and initiate a touch session between the SG PhonePlay application 302 and the primary display touch handler 314 of the SRM. In response, at step 402 the primary display touch handler 314 shows a cursor on the primary display 18 (see FIG. 1) of the gaming machine. At step 404, the player moves his finger along the touch pad in a left, right, up, or down direction. In response, at step 406 the primary display touch handler 314 sends Windows application programming interface (API) events to the Windows OS 316 executing in the gaming machine CPU to move the cursor in the same direction by a factor proportional to the amount by which the player moved his finger along the touch pad. At step 408, when the cursor is at a position that the player desires to select, the player double taps the screen of the mobile device. In response, at step 410 the primary display touch handler 314 sends a touch event to the Windows OS 316 to execute a touch of the primary display at the current location of the cursor. At step 412, the player exits the touch pad mode on the player's mobile device by, for example, selecting a different mode or closing the SG PhonePlay application. In response, at step 414 the primary display touch handler 314 hides the cursor on the primary display of the gaming machine.

In another embodiment, instead of using a track pad on the mobile device to control movement of a cursor on the primary display of the gaming machine, the mobile device may be used as a pointing device to control cursor movement. The mobile device may contain a gravity sensor, accelerometer, magnetometer, and/or gyroscope to determine its orientation and motion. The cursor is moved in response to movement of the mobile device.

Returning to FIG. 6, sequence no. 4 is to record session information in storage media (e.g., NVRAM) of the gaming machine. The PhonePlay server 306 gets session information from the SG PhonePlay application 302, stores the session information in NVRAM, and sends the session information to the SG PhonePlay application 302. The session information may, for example, include the session identifier, start session date/time, end session date/time, and reason for session end (e.g., player logout, host-forced logout because player left proximity of gaming machine). NVRAM may store session information for the last N remote sessions where N is, for example, fifty. This session information can be used to construct a history of remote sessions. The player can view their current session information by selecting the session icon 508 in FIG. 8.

Sequence no. 5 is to end, by player logout, a remote gaming session between the SG PhonePlay application 302 on the player's mobile device 300 and the SRM 62 of the gaming machine. The player may log out of a session either by closing the SG PhonePlay application 302 or by selecting the session icon 508 in FIG. 8 and then selecting a logout option. In response to such logout, the PhonePlay server 306 instructs the VNC server 312 to terminate a VNC session and terminates the web socket connection with the SG PhonePlay application 302.

Sequence nos. 6 and 7 are to track proximity of the player's mobile device 300 to the gaming machine. The player session module 308 instructs the audio QR code generator 310 to generate an ultrasonic (i.e., at a level above the upper limit of human hearing) audio QR code containing the session ID. Through its speakers, the gaming machine repeatedly (e.g., five or ten second intervals) broadcasts the audio QR code for reception by a microphone of the mobile device 300. The SG PhonePlay application 302 uses authorized active monitoring of the mobile device's microphone to interpret the audio QR code. Because ultrasonic audio QR codes are broadcast and interpreted using uncommon frequencies, it is an effective mode for communication to mobile devices operating in noisier environments like casinos. In sequence no. 6, the SG PhonePlay application successfully receives and sends an echo of the audio QR code back to the PhonePlay server 306 of the SRM over the web socket connection. The echo response is sent over the web socket connection (as opposed to ultrasonic audio from a speaker of the player's mobile device) because the gaming machine may not include a microphone. In response to receiving the echo of the audio QR code, the SRM maintains the VNC session and the web socket connection. In sequence no. 7, however, the PhonePlay server 306 does not receive the echo of the audio QR code after a number of attempts, indicating that the SG PhonePlay application failed to receive or respond to the audio QR code. As a result, the PhonePlay server 306 instructs the VNC server 312 terminate the VNC session and terminates the web socket connection with the SG PhonePlay application 302.

Figure 9:
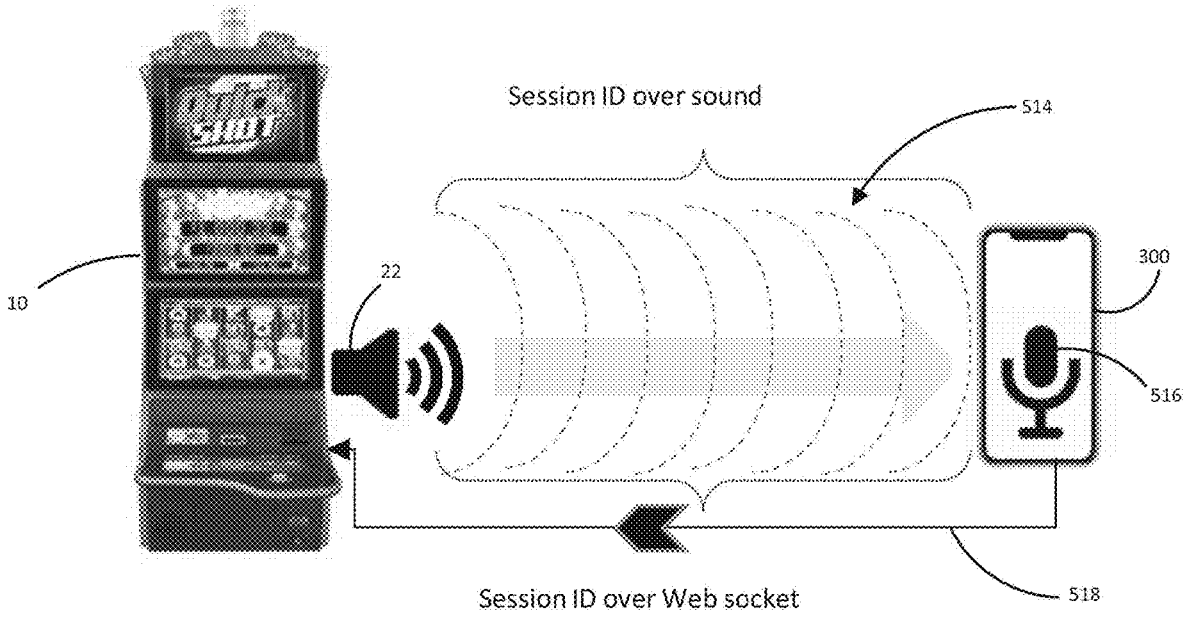
FIG. 9 illustrates the use of an audio code to track proximity of a player's mobile device to a gaming machine during a remote play session in accordance with an embodiment of the present invention.

FIG. 9 illustrates the above-described sequence of a gaming machine 10 emitting an ultrasonic audio QR code 514 containing the session identifier from its speaker(s) 22 for reception by a microphone 516 of the mobile device 300, and the mobile device 300 sending an echo of the audio QR code over the web socket connection 518 between the gaming machine 10 and the mobile device 300. This creates a sort of virtual tether between the mobile device 300 and the gaming machine 10 to ensure reliability of the active connection, to detect when players have left the intended proximity range of the connection, and to ensure the remote session is quickly disconnected when players leave the gaming machine. The inclusion of the same session identifier in the audio QR code and echo ensure that the gaming machine is tethered to a single mobile device. The range of ultrasonic audio QR codes may be configured to ensure the player's mobile device 300 is within a predetermined proximity (e.g., two meters) of the gaming machine 10 during the remote session.

The remote play solution disclosed herein overcomes one or more of the shortcomings associated with other proposed solutions. The SRM and the SG PhonePlay application exploit proven technologies and do not require modifications to existing casino network infrastructure. The SRM may be added to existing gaming machines without modifying or reconfiguring their existing operating system and with minimal or no additional configuration of the SRM itself Accordingly, the remote play solution is relatively cost-effective, easy to implement, and subject to less hurdles to gain regulatory approval.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A method of operating a gaming machine, the gaming machine including a display, a video button panel, and a separately releasable module (SRM), the SRM including a Virtual Network Computing (VNC) server and an audio code generator, the gaming machine having a web socket connection with a nearby mobile device, the VNC server having a VNC session with the mobile device with respect to the video button panel, the method comprising the operations of:

generating, by the audio code generator, an audio code for capture by the mobile device; and receiving, by the SRM from the mobile device, an echo of the audio code over the web socket connection to maintain the VNC session and the web socket connection.

2. The method of claim 1, further including the operation of connecting the gaming machine to a Wi-Fi access point, the mobile device being connected to the Wi-Fi access point.

3. The method of claim 1, further including the operation of displaying a visual code on the gaming machine for capture by the mobile device to establish the web socket connection and the VNC session.

4. The method of claim 1, further including the operation of, in response to the video button panel rendered by a VNC client on the mobile device receiving a player input, executing an action on the gaming machine.

5. The method of claim 4, wherein the action is at least one of selecting a wager, initiating play, viewing game instructions and pays, cashing out any credits on a credit meter, requesting service, or modifying game settings.

6. The method of claim 5, further including the operation of dispensing a ticket from a ticket printer of the gaming machine in response to the action being cashing out any credits on the credit meter.

7. The method of claim 1, wherein the audio code is an ultrasonic audio QR code containing a session identifier.

8. The method of claim 1, further including the operation of terminating, by the SRM, the VNC session and the web socket connection in response to the SRM not receiving the echo of the audio code over the web socket connection.

9. The method of claim 1, wherein the SRM includes a display touch handler, and further including the operations of:

in response to a software application of the mobile device entering a touch pad mode, directing, by the display touch handler, the display to display a cursor thereon;

receiving, by the display touch handler, touch data from the mobile device over the web socket connection; and sending, by the display touch handler, the touch data to a touch screen interface of the display.

10. A method of operating a mobile device in proximity to a gaming machine, the gaming machine including a display, a video button panel, and a separately releasable module (SRM), the SRM including a Virtual Network Computing (VNC) server and an audio code generator, the mobile device having a web socket connection with the gaming machine, the mobile device having a VNC session with the VNC server with respect to the video button panel, the method comprising the operations of:

capturing, by the mobile device, an audio code generated by the audio code generator; and sending, by the mobile device, an echo of the audio code to the SRM over the web socket connection to maintain the VNC session and the web socket connection.

11. The method of claim 10, further including the operation of connecting the mobile device to a Wi-Fi access point, the gaming machine being connected to the Wi-Fi access point.

12. The method of claim 10, further including the operation of capturing, by the mobile device, a visual code displayed on the gaming machine to establish the web socket connection and the VNC session.

13. The method of claim 10, wherein the mobile device includes a software application with a VNC client, and further including the operations of:

rendering, by the VNC client, the video button panel on the mobile device; and receiving a player input at the rendered video button panel to initiate an action on the gaming machine.

14. The method of claim 13, wherein the action is at least one of selecting a wager, initiating play, viewing game instructions and pays, cashing out any credits on a credit meter, requesting service, or modifying game settings.

15. The method of claim 13, wherein the SRM includes a display touch handler, and further including the operations of:

in response to a player input, entering a touch pad mode of the software application;

displaying, by the software application, a touch pad on the mobile device;

receiving, by the software application, a player input to the touch pad; and sending, by the software application, touch data associated with the player input to the primary touch screen handler to initiate a touch action on the display.

16. The method of claim 10, wherein the audio code is an ultrasonic audio QR code containing a session identifier.

17. The method of claim 10, wherein the mobile device loses the web socket connection and the VNC session in response to not sending the echo of the audio code to the SRM over the web socket connection.

18. A gaming machine comprising:

a display configured to display a wagering game;

a video button panel configured to operate the wagering game; and a separately releasable module (SRM) including a Virtual Network Computing (VNC) server and an audio code generator, the SRM configured to perform the operations of:

establishing a web socket connection between the gaming machine and a nearby mobile device;

establishing a VNC session between the VNC server and the mobile device with respect to the video button panel;

generating, by the audio code generator, an audio code for capture by the mobile device; and receiving, by the SRM from the mobile device, an echo of the audio code over the web socket connection to maintain the VNC session and the web socket connection.

19. The gaming machine of claim 18, wherein the SRM is configured to perform the operation of displaying a visual code on the gaming machine for capture by the mobile device to establish the web socket connection and the VNC session.

20. The gaming machine of claim 18, wherein the audio code is an ultrasonic audio QR code containing a session identifier.

21. The gaming machine of claim 18, wherein the SRM is configured to perform the operation of terminating the VNC session and the web socket connection in response to the SRM not receiving the echo of the audio code over the web socket connection.

22. The gaming machine of claim 18, wherein the SRM is configured to perform the operation of, in response to the video button panel rendered by a VNC client on the mobile device receiving a player input, triggering an action on the gaming machine.

23. The gaming machine of claim 18, wherein the SRM includes a display touch handler, and wherein the SRM is configured to perform the operations of:

in response to a software application of the mobile device entering a touch pad mode, directing, by the display touch handler, the display to display a cursor thereon;

receiving, by the display touch handler, touch data from the mobile device over the web socket connection; and sending, by the display touch handler, the touch data to a touch screen interface of the display.

* * * * *